US006502933B2

(12) United States Patent
Lim et al.

(10) Patent No.: US 6,502,933 B2
(45) Date of Patent: Jan. 7, 2003

(54) INK CARTRIDGE FOR INK JET PRINTER

(75) Inventors: Dae-soon Lim, Yongin (KR); Jae-ho Moon, Suwon (KR); Jeong-seon Kim, Suwon (KR)

(73) Assignee: SamSung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/761,841

(22) Filed: Jan. 18, 2001

(65) Prior Publication Data

US 2002/0054192 A1 May 9, 2002

(30) Foreign Application Priority Data

Nov. 6, 2000 (KR) ..... 00-65519

(51) Int. Cl.[7] ..... B41J 2/175
(52) U.S. Cl. ..... 347/86
(58) Field of Search ..... 347/85, 86, 87, 347/7

(56) References Cited

U.S. PATENT DOCUMENTS 4,771,295 A * 9/1988 Baker et al. ..... 347/87
5,583,544 A * 12/1996 Stamer et al. ..... 347/7
5,790,157 A * 8/1998 Higuma et al. ..... 347/85
5,877,794 A * 3/1999 Takagi ..... 347/87
6,247,803 B1 * 6/2001 Kanaya et al. ..... 347/86
6,273,562 B1 * 8/2001 Deshmukh ..... 347/86

OTHER PUBLICATIONS

Korean Patent Application No. 2001–48737 to Kim et al., filed on Aug. 13, 2001 with an English language translation and a certificate of the translation.

* cited by examiner

*Primary Examiner*—Michael Nghiem
(74) *Attorney, Agent, or Firm*—Robert E. Bushnell, Esq.

(57) ABSTRACT

An ink cartridge for an ink jet printer includes an ink storing portion for containing ink and a head for ejecting droplets of the ink stored in the ink storing portion. The ink storing portion includes a chamber filed with ink in a liquid state, a negative pressure maintaining apparatus for maintaining the pressure of the inside of the chamber to be negative, and a uniform supply guide apparatus, installed between the chamber and the head, for guiding the ink in the chamber to be uniformly supplied to the head. Thus, since the ink is used by being stored in a liquid state, most of the amount of the stored ink can be used for printing, so that the efficiency in use can be improved much.

15 Claims, 4 Drawing Sheets

INK CARTRIDGE FOR INK JET PRINTER

CLAIM OF PRIORITY

This application makes reference to, incorporates the same herein, and claims all benefits accruing under 35 U.S.C. §119 from my application entitled INK CARTRIDGE FOR INK JET PRINTER filed with the Korean Industrial Property Office on Nov. 6, 2000 and there duly assigned Serial No. 00-65519.

BACKGROUND OF THE INVENTION

1. Field of the Invention

The present invention relates to an ink cartridge used for an ink jet printer. In particular, this invention provides an apparatus and a method of using an ink cartridge that efficiently consumes nearly all the ink that is emptied into the cartridge. Furthermore, an automatic sensing means is disclosed to electrically determine when the ink cartridge needs to be refilled.

2. Description of the Related Art

In general, an ink cartridge for an ink jet printer containing ink ejects droplets of ink from a head to print an image of a predetermined color on a sheet of paper. However, ink jet printers contain a sponge within the ink cartridge to hold and dispense the ink. Unfortunately since the sponge takes up nearly all the space inside the cartridge, the cartridge will have to be replaced even when there is a substantial amount of ink left in the sponge. This is wasteful. Also, ink cartridges contain no means for allowing the user to know when the cartridge has to be replaced.

SUMMARY OF THE INVENTION

It is therefore an object of the present invention to provide an improved ink cartridge.

It is also an object of the present invention to provide an ink cartridge for an ink jet printer which can improve the efficiency in use of stored ink while preventing a wetting phenomenon.

It is further an object of the present invention to provide an electrical sensor to alert the user when the ink cartridge is empty.

It is still yet another object of the present invention to provide a mechanism that continuously maintains negative pressure (or a pressure below atmospheric pressure) inside the ink cartridge until all the ink inside the ink cartridge is consumed.

Accordingly, to achieve the above object, there is provided an ink cartridge for an ink jet printer having an ink storing portion for containing ink and a head for ejecting droplets of the ink stored in the ink storing portion, wherein the ink storing portion comprises a chamber filed with ink in a liquid state, a negative pressure maintaining means for maintaining the pressure of the inside of the chamber to be negative, and a uniform supply guide means, installed between the chamber and the head, for guiding the ink in the chamber to be uniformly supplied to the head.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
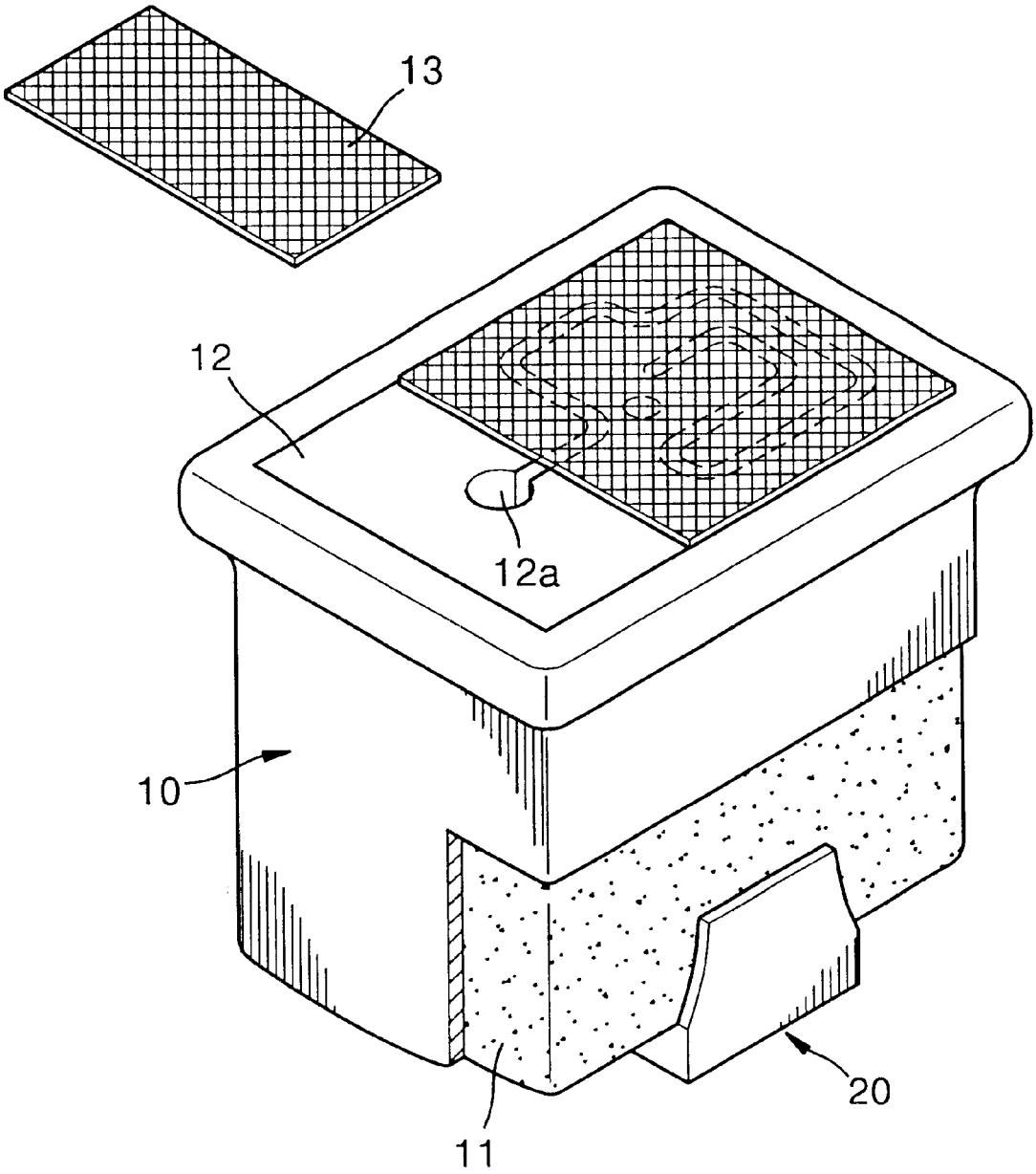
FIG. 1 (PRIOR ART)
FIG. 1 is a perspective view showing a conventional ink cartridge.

The ink cartridge for an ink jet printer includes, as shown in FIG. 1, an ink storing portion 10 for containing ink and a head 20 for ejecting droplets of ink. The ink storing portion 10 is filled with sponge 11 holding ink. A cover 12 for covering the ink storing portion 10 has an air inlet hole 12*a* so that air can enter the inside of the ink storing portion 10 when a plastic cover 13 for opening is detached. The ink stored in the sponge 11 is supplied to the head 20 due to a capillary attraction phenomenon, and the ink is ejected in droplets when needed.

However, in the above structure, since the ink is held in pores of the sponge 11 and moved toward the head 20 due to the capillary attraction phenomenon, an excess amount of the ink hardly comes out from the head 20. Thus, although a wetting phenomenon in which the head 20 is always wet even when no printing is performed can be prevented, it is disadvantageous that the efficiency in use of ink is quite low. That is, since the ink held by the sponge 11 is supplied to the head 20 by using the capillary attraction phenomenon only, it is difficult to use all the ink held by the sponge 11. In particular, if a portion of the sponge 11 happens to be folded when it is inserted in the ink storing portion 10, since the ink held by the folded portion of the sponge 11 is difficult to move, most of the ink in the folded portion cannot be used. Thus, about 50% of the amount of available ink is actually used and the remaining amount in the sponge 11 is disposed of without being used. Also, since the ink cartridge is disposed of when it still contains a large amount of ink, even if the ink storing portion 10 is designed to be transparent so that the inside thereof can be seen, it is not possible to estimate how long the ink can be used. Therefore, a new ink cartridge which can improve the efficiency in use of the stored ink is needed.

Figure 2:
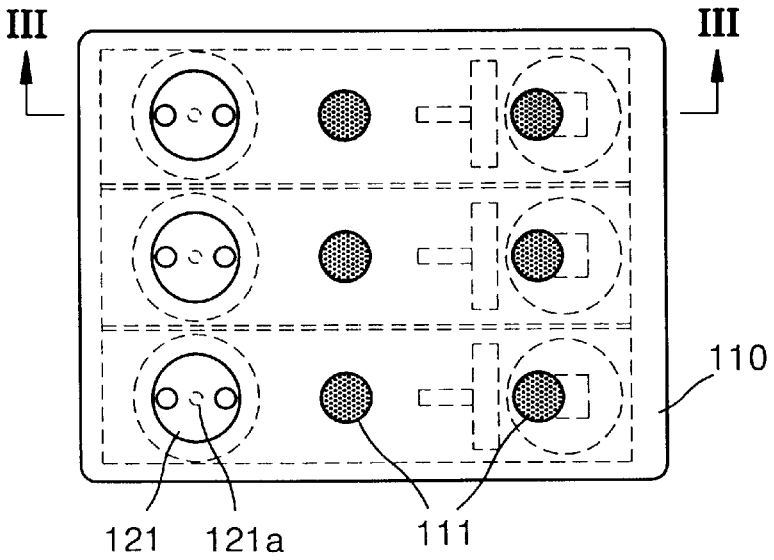
FIG. 2 is a plan view showing an ink cartridge according to a preferred embodiment of the present invention.
Figure 3:
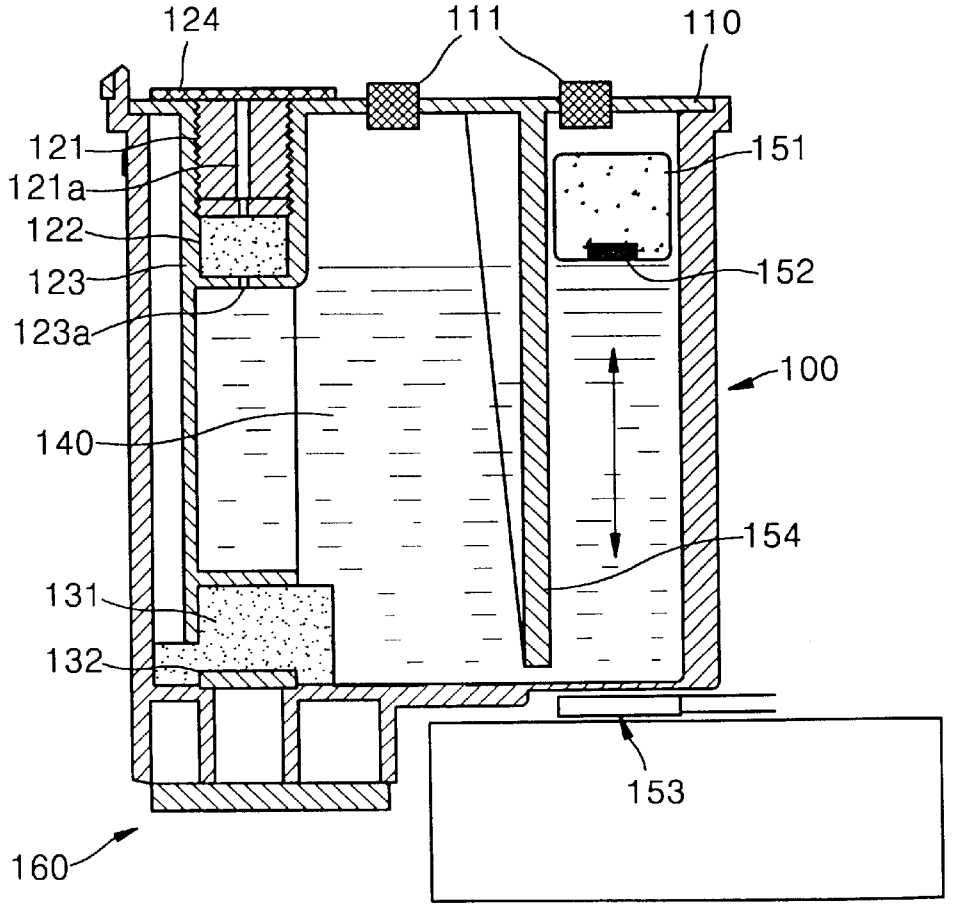
FIG. 3 is a sectional view taken along line III—III of FIG. 2.

Referring to FIGS. 2 and 3, a color ink cartridge in which ink of three colors, that is, yellow, magenta and cyan, are respectively stored in three ink storing portions. Each of the ink storing portions has the same structure as shown in FIG. 3. As shown in FIGS. 2 and 3, an ink cartridge according to the present invention includes an ink storing portion 100 for containing ink and a head 160 for ejecting droplets of ink. The ink storing portion 100 includes a chamber 140 for containing ink, a negative pressure maintaining means installed at the upper portion of the chamber 140, a uniform supply guide means installed at the lower portion of the chamber 140, and a detecting means installed at the side wall of the ink storing portion 100.

The chamber 140 of the present invention contains ink in its liquid state, not letting the ink be held by a porous medium such as a sponge. Thus, the ink in the chamber 140 can be easily moved toward the head 160 positioned at the bottom side of the chamber 140 due to the mobility and self-weight of the ink. However, since the ink in the chamber 140 remains in a liquid state, if the pressure inside the chamber 140 is not negative, an excess amount of the ink leaks out through the head 160 so that a wetting phenomenon may occur. Thus, the negative pressure maintaining means maintains the pressure inside the chamber 140 to be negative, which includes a first sponge 122 installed at an accommodating portion 123 where a through hole 123*a* is formed, and a screw 121 pressing the first sponge 122 toward the through hole 123*a*. The one side of the accommodating portion 123 is open to the outside, and a hole 121*a* penetrating the inside of the screw 121 which is inserted in the accommodating portion 123 is formed. Accordingly, the outside air can be transferred to the inside of the chamber 140 via the hole 121*a*, pores of the first sponge 122, and the through hole 123*a*. However, if the air is transferred to the inside of the chamber 140, it should pass the pores of the first sponge. Here, the size of the pore is decreased as the screw 121 presses the first sponge 122. That is, as the screw 121 presses the first sponge 122 much, the pores become smaller so that the air does not pass well. As a result, a stronger negative pressure is generated inside the chamber 140. In contrast, when a pressing force of the screw 121 is released, the air passes relatively well so that the negative pressure inside the chamber 140 gradually decreases. Thus, by adjusting the pressing force of the screw 121, the negative pressure inside the chamber 140 can be adjusted. Reference numeral 124 denotes a protective tape covering the hole 121*a* which is removed when the ink cartridge is in use.

The uniform supply guide means guides the ink stored in the chamber 140 to be uniformly supplied to the head 160, and includes a second sponge 131 installed at an ink exhaust pass between the chamber 140 and the head 160. The ink in the chamber 140 is primarily absorbed by the second sponge 131 and then transferred to the head 160. Thus, even when the ink is in a liquid state in which it freely flows, since the ink should pass through the second sponge 131, an excess amount of the ink is prevented from coming out from the head 160. In contrast, when the ink is almost consumed and remains a little at the bottom surface, the second sponge 131 holding the ink can supply the ink to the head 160 so that the ink can be uniformly supplied to the end. Therefore, the ink stored in the chamber 140 can always be uniformly supplied to the head 160 by the uniform supply guide means.

The detecting means senses and notifies the state of ink consumption in the chamber 140, and includes a Styrofoam float 151 provided to float on the ink in the chamber 140, a magnet 152 installed at the Styrofoam float 151, and a proximity sensor 153 for detecting the approximation of the magnet 152. Reference numeral 154 denotes a guide plate for guiding moving up and down of the Styrofoam float 151 floating on the ink. In the above structure, when the chamber 140 is nearly filled with the ink, the Styrofoam float 151 rises so that the proximity sensor 153 does not work. However, when the ink is almost consumed and the Styrofoam float 151 is lowered near the bottom, the proximity sensor 153 detects the magnet 152 and generates a signal. Thus, the ink consumption state is identified from the signal of the proximity sensor 153 so that a user can see the time to replace the ink cartridge.

Figure 4:
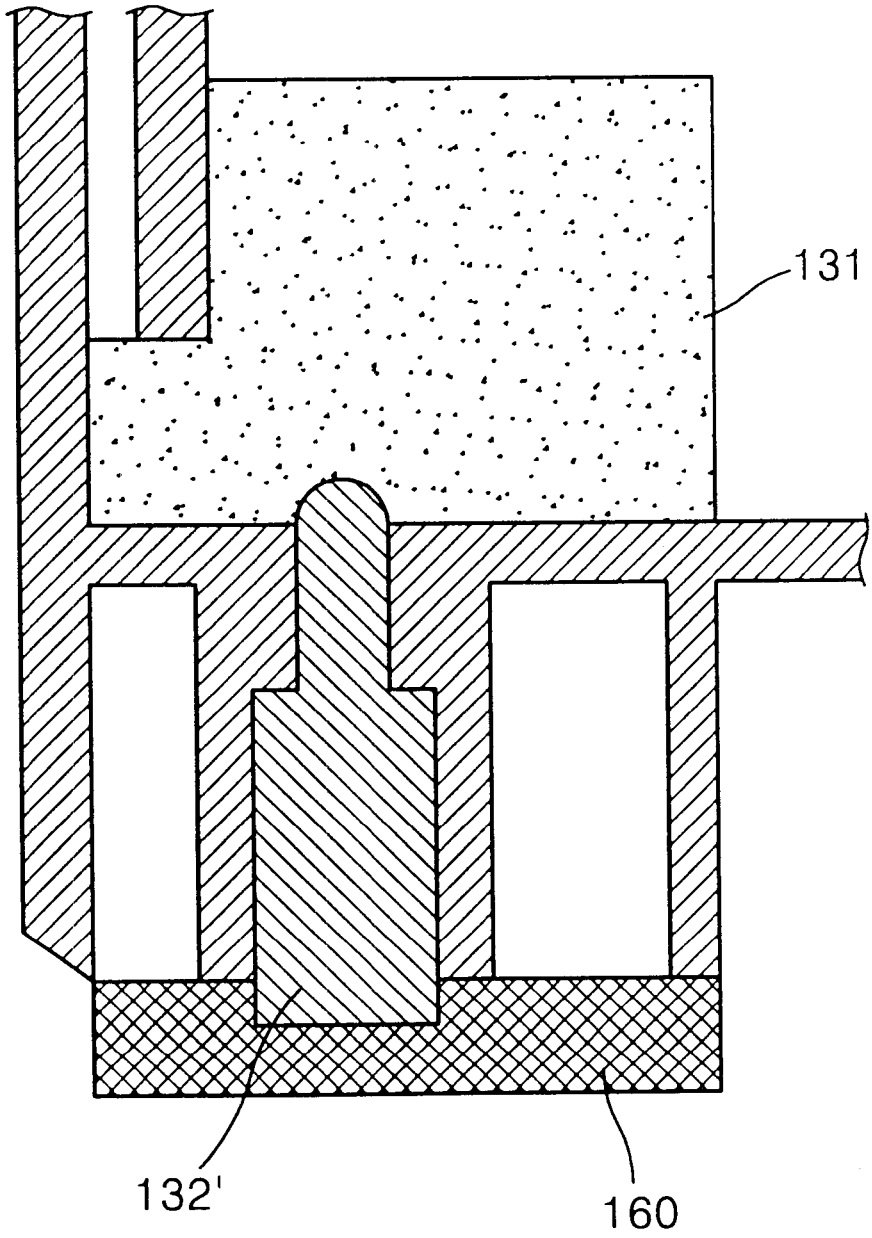
FIG. 4 is a sectional view showing an example of modifications to the structure of FIG. 3.

Reference numeral 110 denotes a cover and reference numeral 111 denotes rubber portions installed at the cover 110. Ink is injected in to the chamber 140 by an injection needle piercing the rubber portions 111. Reference numeral 132 denotes a filter for filtering impurities and fine bubbles in the ink to prevent an outlet (not shown) of the head 160 from being blocked. While the filter 132 is installed in the chamber 140 as shown in FIG. 3, a filter 132' which is inserted from the outside of the chamber 140 toward the inside thereof may be adopted as shown in FIG. 4.

In the overall operation of the ink cartridge having the above structure according to the present invention, as the screw 121 presses the first sponge 122 so that the pores of the first sponge 122 are decreased, the negative pressure maintaining means maintain the pressure of the chamber 140 to be negative. The second sponge 131 of the uniform supply guide means absorbs the ink in the chamber 140 and supplies the ink to the head 160, so that a uniform amount of ink can be supplied. Also, the detecting means including the Styrofoam float 151 and the magnet 152 notifies the time to replace the ink by the operation of the proximity sensor 153 when the ink is almost consumed.

Thus, in the ink cartridge of the present invention, since the ink is stored in a liquid state in which the ink can freely flow and be supplied to the head 160, not stored by being absorbed in a porous medium such as a sponge, most of the stored amount of the ink can be used for a printing process. That is, compared to the conventional technology in which a large amount of ink held by the sponge is wasted, in the present invention, since most of the ink inside the chamber 140 can be supplied to the head 160, an efficiency in use is greatly improved. Since the pressure of the chamber 140 is appropriately maintained to be negative by the negative pressure maintaining means, even when ink in a liquid state is used, the wetting phenomenon generated at the head 160 can be prevented. Also, since the ink is uniformly supplied by the uniform supply guide means, the time for replacing the ink cartridge can be determined through the detecting means.

Figure 5:
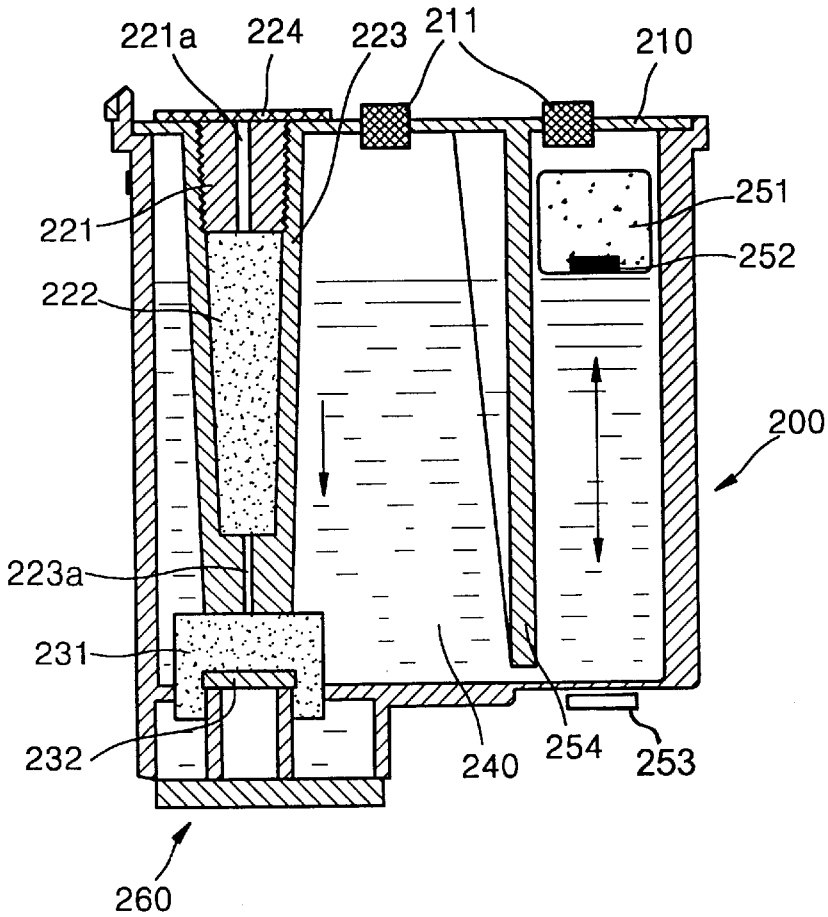
FIG. 5 is a sectional view showing an ink cartridge according to another preferred embodiment of the present invention.

Next, referring to FIG. 5, an ink cartridge according to a second embodiment of the present invention includes an ink storing portion 200 for containing ink, and a head 260 for ejecting droplets of the ink. The ink storing portion 200 includes a chamber 240 filled with ink, a negative pressure maintaining means installed at the upper portion of the chamber 240, a uniform supply guide means installed at the lower portion of the chamber 240, and a detecting means installed the side wall of the chamber 240.

Ink in a liquid state is stored in the chamber 240. The negative pressure maintaining means maintains the pressure of the chamber 240 to be negative, and includes a first sponge 222 installed at an accommodating portion 223 where a through hole 223*a* is formed, and a screw 221 pressing the first sponge 222 toward the through hole 223*a*. The one side of the accommodating portion 223 is open, and a hole 221*a* penetrating the inside the screw 221 is formed. The screw 221 is inserted in the accommodating portion 223. Accordingly, air from the outside can be transferred to the inside of the chamber 240 via the hole 221*a*, pores of the first sponge 222, and the through hole 223*a*. Reference numeral 224 denotes a protection tape covering the hole 221*a* which is removed when the ink cartridge is used.

The uniform supply guide means guides the ink stored in the chamber 240 to be uniformly supplied to the head 260, and includes a second sponge 231 installed on an ink exhaust pass between the chamber 240 and the head 260. The ink in the chamber 240 is absorbed by the second sponge 231 and then is transferred toward the head 260.

In this preferred embodiment of the present invention, it is a characteristic feature that the accommodating portion 223 is formed to be lengthy so that the leading portion of the accommodating portion 223 can contact the second sponge 231. Accordingly, a passage for the outside air formed by the hole 221*a*, the first sponge 222 and the through hole 223*a* is submerged in the ink until the ink is almost consumed. That is, in the first preferred embodiment, when the ink is used not too much, a space for the outside air is generated under the through hole 123*a* (see FIG. 3). Then, as such a state is maintained for a long time, the outside air gradually comes into the chamber so that the pressure of the inside of the chamber may be equal to the outside pressure. However, in the second preferred embodiment of the present invention, since the passage for the outside air is always submerged in the ink, a change in pressure according to the lapse of time can be restricted.

Figure 6:
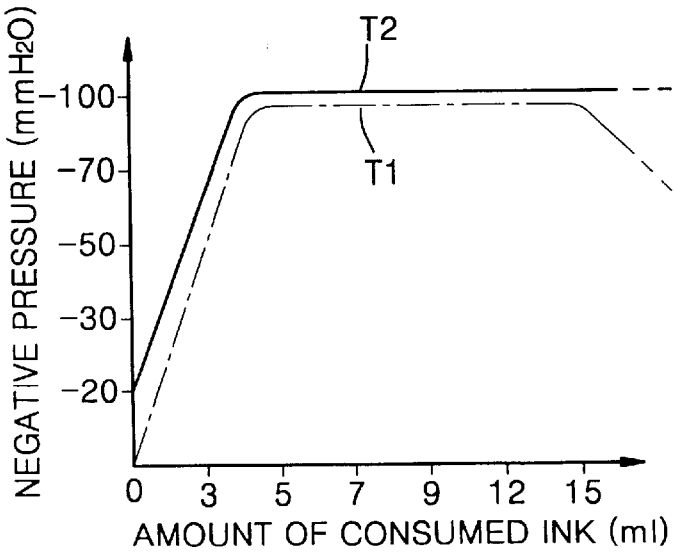
FIG. 6 is a graph showing the results of measurements of pressure in the cartridges according to the preferred embodiments shown in FIGS. 2 and 5.

According to the results of actual experiments, as shown in a graph of FIG. 6, it can be seen that, in the first preferred embodiment, the internal negative pressure gradually decreases as the amount of consumption of ink exceeds about 15 ml while, in the second preferred embodiment, the internal negative pressure is almost uniformly maintained. Thus, according to the second preferred embodiment, the lowering of the negative pressure can be prevented. The accommodating portion 223 is tapered such that the diameter of the accommodating portion 223 becomes progressively smaller toward the through hole 223*a*. Accordingly, since the size of a pore of the first sponge 222 becomes progressively smaller toward the through hole 223*a*, pressure due to capillary attraction applies toward the through hole 223*a*. Thus, when the ink comes into the first sponge 222 through the through hole 223*a* submerged in the ink, a portion of the first sponge 222 around the through hole 223*a* is mainly soaked due to the capillary attraction so that the ink does not leak from the hole 221*a* of the screw 221. Since the structure and functions of other elements are the same as those of the first preferred embodiment, detailed descriptions thereof will be omitted.

Reference numerals 251, 252 and 253 respectively denote a Styrofoam float, a magnet and a proximity sensor which constitute the detecting means. Reference numeral 254 denotes a guide plate for guiding moving up and down of the Styrofoam float 251 floating on the ink. Also, reference numerals 210, 211 and 232 denote a cover, rubber portions installed at the cover 210, and a filter, respectively.

Therefore, in the structure according to the second preferred embodiment of the present invention, the lowering of the negative pressure inside the chamber can be prevented and simultaneously an efficiency in use of ink can be improved.

As described above, in the ink cartridge according to the present invention, since the ink is used by being stored in a liquid state, most of the amount of the stored ink can be used for printing, so that the efficiency in use can be improved much. Also, since the detecting means for detecting the state of ink consumption is provided, the time for replacing the ink cartridge can be easily notified.

What is claimed is:

1. An ink cartridge for an ink jet printer having an ink storing portion for containing ink and a head for ejecting droplets of the ink stored in the ink storing portion, wherein the ink storing portion comprises:

a chamber filed with ink in a liquid state;

a negative pressure maintaining means comprising a pressing member maintaining the pressure of the inside of the chamber to be negative; and a uniform supply guide means, installed between the chamber and the head, for guiding the ink in the chamber to be uniformly supplied to the head, the negative pressure maintaining means comprising:

an accommodating portion having one side open and a through hole connected to the chamber formed at the other side thereof; and a first sponge installed in the accommodating portion to contact the through hole, said pressing member comprising a screw installed at the accommodating portion and having a hole formed therein to connect the open side of the accommodating portion and the side thereof toward the first sponge pressing the first sponge toward the through hole to decrease pore size of the first sponge.

2. The ink cartridge as claimed in claim 1, wherein the uniform supply guide means comprises a second sponge, installed on an ink exhaust pass between the chamber and the head, for absorbing the ink in the chamber and transferring the absorbed ink toward the head.

3. The ink cartridge as claimed in claim 2, wherein the accommodating portion is formed such that a leading end portion thereof contacts the second sponge.

4. The ink cartridge as claimed in claim 3, wherein the accommodating portion is tapered such that the diameter of the accommodating portion becomes progressively smaller toward the through hole.

5. The ink cartridge as claimed in claim 1, wherein the ink storing portion further comprises a detecting means for detecting the state of consumption of the ink in the chamber.

6. The ink cartridge as claimed in claim 5, wherein the detecting means comprises:

a Styrofoam float installed in the chamber to be capable of floating;

a magnet installed at the Styrofoam float; and a proximity sensor for detecting the position of the magnet and notifying the state of consumption of the ink.

7. A method for operating an ink cartridge, comprising the steps of:

piercing a rubber portion on a cover of said ink cartridge with an injection needle and filling said ink cartridge with ink;

removing a protective tape off said cover of said ink cartridge;

inserting a sponge into a compartment in said ink cartridge and allowing said sponge to become fully saturated with ink;

fastening a screw containing an air hole through a screw center onto said sponge, squeezing said sponge until the pores of the sponge become much smaller, said screw and said sponge generating a negative pressure within said ink cartridge; and operating said ink cartridge until an electrical circuit indicates said ink cartridge is empty.

8. The method of claim 7, wherein said electrical circuit is comprised of a sensor at a bottom of said ink cartridge and a magnet attached to a float inside said ink cartridge and said electrical circuit indicates an empty ink cartridge when said magnet attached to said float is drawn near said sensor caused by the usage of ink.

9. The method of claim 7, wherein said sponge is conical shaped to fit within a conical shaped compartment.

10. An ink cartridge, comprising:

a cover having a plurality of rubber portions and a single storing portion formed therein, said cover being partially covered by a removable protective tape that covers said storing portion, said tape being removed upon use of said ink cartridge, said rubber portions enabling injection of ink via an injection needle into said ink cartridge; and said storing portion comprising:

a chamber filed with ink in a liquid state;

a negative pressure maintaining means for maintaining the pressure of the inside of the chamber to be negative; and a uniform supply guide means, installed between the chamber and the head, for guiding the ink in the chamber to be uniformly supplied to the head, the negative pressure maintaining means comprising:

an accommodating portion having one side open and a through hole connected to the chamber formed at the other side thereof;

a first sponge installed in the accommodating portion to contact the through hole; and a screw, installed at the accommodating portion and having a hole formed therein to connect the open side of the accommodating portion and the side thereof toward the first sponge, for pressing the first sponge toward the through hole to decrease pore size of the first sponge.

11. The ink cartridge of claim 10, wherein the uniform supply guide means comprises a second sponge, installed on an ink exhaust pass between the chamber and the head, for absorbing the ink in the chamber and transferring the absorbed ink toward the head.

12. The ink cartridge of claim 11, wherein the accommodating portion is formed such that a leading end portion thereof contacts the second sponge.

13. The ink cartridge of claim 12, wherein the accommodating portion is tapered such that the diameter of the accommodating portion becomes progressively smaller toward the through hole.

14. The ink cartridge of claim 10, wherein the ink storing portion further comprises a detecting means for detecting the state of consumption of the ink in the chamber.

15. The ink cartridge of claim 14, wherein the detecting means comprises:

a Styrofoam float installed in the chamber to be capable of floating;

a magnet installed at the Styrofoam float; and a proximity sensor for detecting the position of the magnet and notifying a user when said ink cartridge is empty of ink.

* * * * *